US008960573B2

(12) United States Patent
Engelberg

(10) Patent No.: US 8,960,573 B2
(45) Date of Patent: Feb. 24, 2015

(54) DEVICE FOR INJECTING FUEL

(75) Inventor: Ralph Engelberg, Ditzingen (DE)

(73) Assignee: Robert Bosch GmbH, Stuttgart (DE)

( * ) Notice: Subject to any disclaimer, the term of this patent is extended or adjusted under 35 U.S.C. 154(b) by 465 days.

(21) Appl. No.: 13/259,438

(22) PCT Filed: Mar. 5, 2010

(86) PCT No.: PCT/EP2010/052814
§ 371 (c)(1),
(2), (4) Date: Dec. 6, 2011

(87) PCT Pub. No.: WO2010/127887
PCT Pub. Date: Nov. 11, 2010

(65) Prior Publication Data

US 2012/0074245 A1 Mar. 29, 2012

(30) Foreign Application Priority Data

May 6, 2009 (DE) ..... 10 2009 002 840

(51) Int. Cl.

| | |
|---|---|
| ***B05B 1/30*** | (2006.01) |
| ***F02M 51/00*** | (2006.01) |
| ***F02M 51/06*** | (2006.01) |
| ***F02M 61/08*** | (2006.01) |
| ***F02M 61/16*** | (2006.01) |

(52) U.S. Cl.
CPC ..... *F02M 51/061* (2013.01); *F02M 61/08* (2013.01); *F02M 61/16* (2013.01)
USPC ..... 239/585.2; 239/584; 239/585.1; 239/585.3

(58) Field of Classification Search
CPC ..... F02M 51/061; F02M 61/08; F02M 61/16
USPC ..... 239/584, 585.1, 585.2, 585.3
See application file for complete search history.

(56) References Cited

U.S. PATENT DOCUMENTS

| | | | | |
|---|---|---|---|---|
| 4,695,034 | A * | 9/1987 | Shimizu et al. | 251/129.06 |
| 4,725,002 | A * | 2/1988 | Trachte | 239/102.2 |
| 5,031,841 | A * | 7/1991 | Schafer | 239/584 |
| 5,169,067 | A * | 12/1992 | Matsusaka et al. | 239/102.2 |

(Continued)

FOREIGN PATENT DOCUMENTS

| | | |
|---|---|---|
| DE | 100 60 939 | 6/2002 |
| RU | 2 247 855 | 3/2005 |

(Continued)

*Primary Examiner* — Ryan Reis
(74) *Attorney, Agent, or Firm* — Kenyon & Kenyon LLP

(57) ABSTRACT

A device is described for injecting fuel, which includes a valve body, an outwardly opening valve needle, which is disposed in the valve body in a pressure chamber filled with fuel, to which pressurized fuel is supplied; a restoring element, which returns the valve needle to an original position; an electromagnetic actuator, which is disposed in an actuator chamber for actuating the valve needle; and a diaphragm, which is disposed in the actuator chamber and subdivides the actuator chamber into a first, fuel-filled region and a second, fuel-free region in fluid-tight manner, and which subdivides the valve needle into an injection-side portion and an actuator-side portion, the injection-side portion of the valve needle including a pressure-compensation plunger, which separates the pressure chamber from the first, fuel-filled region of the actuator chamber, the actuator being disposed in the second, fuel-free region.

10 Claims, 1 Drawing Sheet

(56) References Cited

U.S. PATENT DOCUMENTS

| | | | | |
|---|---|---|---|---|
| RE34,945 | E * | 5/1995 | Sayer et al. | 239/5 |
| 6,655,605 | B2 * | 12/2003 | Stoecklein et al. | 239/102.2 |
| 6,971,172 | B2 * | 12/2005 | Crofts | 29/890.125 |
| 6,994,110 | B2 * | 2/2006 | Barillot et al. | 137/554 |

FOREIGN PATENT DOCUMENTS

| | | |
|---|---|---|
| WO | 2003/089781 | 10/2003 |
| WO | 2005/050001 | 6/2005 |

* cited by examiner

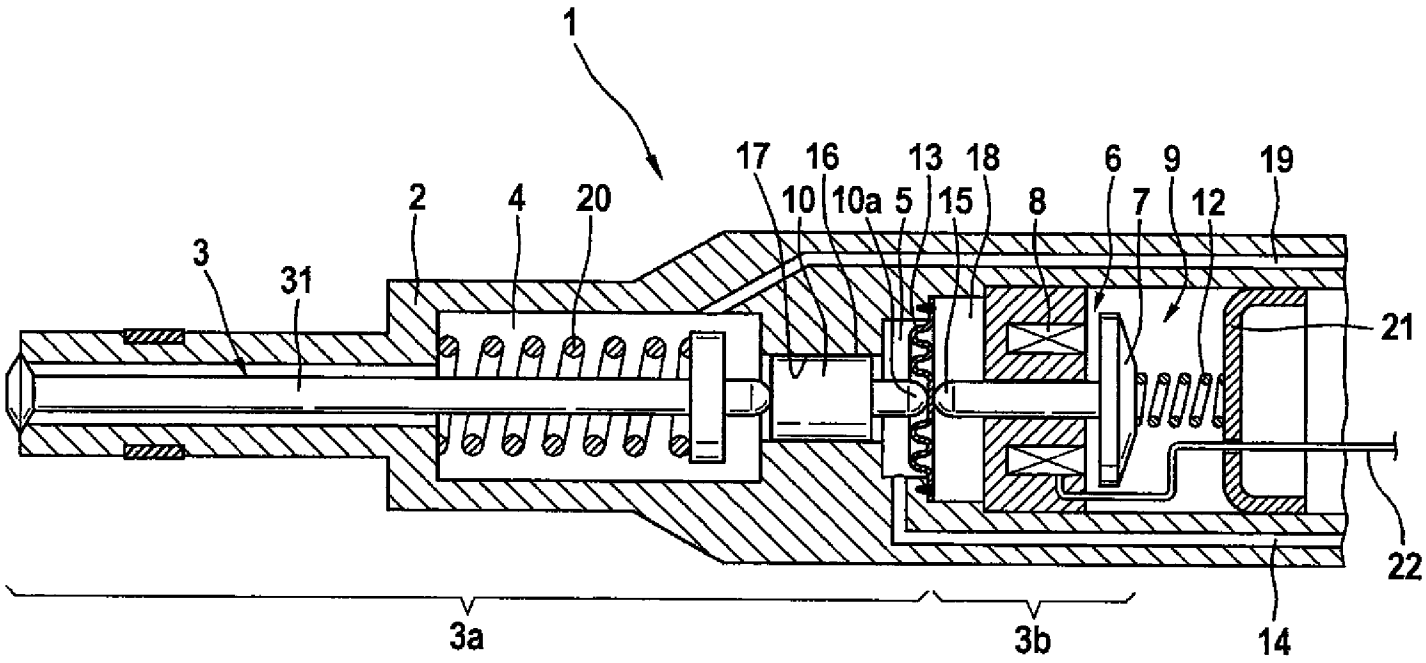
1
2
4
20
31
3
17
16
10
10a
5
13
15
18
8
6
7
9
12
19
21
22
14
3a
3b

DEVICE FOR INJECTING FUEL

FIELD OF THE INVENTION

The present invention relates to a device for injecting fuel, which is able to be used especially in internal combustion engines having direct injection in stratified-charge operation.

BACKGROUND INFORMATION

In the related art, fuel injection devices for internal combustion engines having direct injection are usually implemented as high-pressure injection valves having outwardly opening valve needles, which are actuated with the aid of piezo actuators and controlled by costly output stages for the required highly dynamic switching times. High demands on material quality and manufacturing tolerances of the individual components of these injection valves lead to long processing, testing and manufacturing times and, as a result, to high manufacturing costs of these injection valves.

Seen this way, these high-pressure injection valves of the related art are not fully suitable for providing a simple device which is able to be produced cost-effectively, for the injection of fuel for internal combustion engines having direct injection in stratified-charge operation.

SUMMARY OF THE INVENTION

In contrast, the device according to the present invention for the injection of fuel, having the features described herein, has the advantage that it not only has a less complicated and thus more cost-effective structure, but also is less critical with regard to the required manufacturing and bearing tolerances of the individual components. According to the exemplary embodiments and/or exemplary methods of the present invention, this is achieved in that the device for injecting fuel has a multi-part, outwardly opening valve needle, and a diaphragm which subdivides an actuator chamber into a first, fuel-filled region, and a second, fuel-free region in fluid-tight manner, and simultaneously subdivides the valve needle into an injection-side portion and an actuator-side portion. Through a pressure-compensation plunger, which is disposed on the injection-side portion of the valve needle, a pressure chamber filled with fuel is separated from the first, fuel-filled region of the actuator chamber. Because the actuator in this case is disposed in the second, fuel-free region of the actuator chamber, a cost-effective electromagnetic actuator, which is able to achieve the desired highly dynamic switching times, is able to be used. Furthermore, the advantageous use of special magnetically soft materials is possible in the actuator because the actuator components are not exposed to any corrosive effect of the fuel.

The further descriptions herein show further developments of the present invention.

According to one further development of the present invention, the pressure-compensation plunger is situated in a cylindrical bore of a valve body with low play and in a manner allowing displacement, and is provided with a sealing gap. In this way, a simple and operationally safe reduction in the fuel pressure applied in the pressure chamber is achievable with respect to the abutting first region of the actuator chamber.

The device according to the present invention may have a fuel return line from the first region of the actuator chamber to a fuel reservoir. As a result, the ambient pressure prevailing in the fuel reservoir, which also acts on the side of the diaphragm facing this region, is essentially applied in the first, fuel-filled region of the actuator chamber.

Since only ambient pressure advantageously prevails in the second, fuel-free region of the actuator chamber as well and thus on the other diaphragm side, a simple and cost-effective, in particular thin, development of the diaphragm may be used due to an absent or only negligible pressure load.

Furthermore, an armature may be situated on the actuator-side portion of the valve needle. This results in a simple and cost-effective structure of the actuator, which uses a minimized number of components and a compact installation volume.

According to another development of the exemplary embodiments and/or exemplary methods of the present invention, the actuator includes a free travel spring whose spring force is such that the actuator-side portion of the valve needle is resting against the diaphragm at all times, even when the actuator is not actuated. This avoids excessive loading and an attendant reduced durability of the diaphragm, and the armature lies in a defined starting position.

The restoring element may be configured in such a way that the injector-side portion of the valve needle is always resting against the diaphragm, even when the actuator is not actuated, that is to say, when the valve needle is closed. This prevents the pressure-compensation plunger from lifting off from the diaphragm and avoids impact stress on the diaphragm, which in turn contributes to increased durability or increased service life of the diaphragm.

In an especially particular manner, the actuator-side and the injector-side portions are always resting against the diaphragm in every operating state of the injection device.

According to another development of the exemplary embodiments and/or exemplary methods of the present invention, the injector-side portion of the valve needle is implemented in two parts, with a needle and the pressure-compensation plunger. This allows for separate production and processing of these components at the individually required measuring tolerances, which provides further cost savings.

One end of the pressure-compensation plunger facing the diaphragm, and one end of the actuator-side portion of the valve needle facing the diaphragm has a rounded design in each case. This ensures a homogeneous seat of these ends, especially in a shifted, i.e., bulging, state of the diaphragm, and prevents damage to the diaphragm, for instance by sharp edges of non-rounded terminal regions of the pressure-compensation plunger and the actuator-side portion of the valve needle.

An exemplary embodiment of the present invention is described in detail below, with reference to the accompanying drawing.

BRIEF DESCRIPTION OF THE DRAWING

FIG. 1 shows a schematically simplified sectional view of an exemplary embodiment of the device according to the present invention.

DETAILED DESCRIPTION

A device for injecting fuel according to an exemplary embodiment of the present invention will be described in detail in the following text with reference to FIG. 1.

As can be gathered from the schematic sectional view of FIG. 1, device 1 for the injection of fuel includes a valve body 2 as well as an outwardly opening valve needle 3, which is made up of an injection-side portion 3*a* and an actuator-side portion 3*b*. Injection-side portion 3*a* of valve needle 3 includes a needle 31 and a pressure-compensation plunger 10, which are disposed in a pressure chamber 4, to which pressurized fuel is supplied via an intake line 19. Pressure-compensation plunger 10 is situated in a cylindrical bore 16 of valve body 2 with little play and in displaceable manner.

Furthermore, a restoring element 20 is disposed in pressure chamber 4, which is supported between valve body 2 and needle 31 and returns valve needle 3 to an original position following the actuation.

Situated in an actuator chamber 9 is an electromagnetic actuator 6, which includes a coil 8 and an armature 7, which may be of the flat armature type shown here, which is fixed in place on actuator-side portion 3*b* of valve needle 3.

In addition, a diaphragm 13 is situated in actuator chamber 9, which is fixed in place on valve body 2 and, on the one hand, subdivides valve needle 3 into injection-side portion 3*a* and actuator-side portion 3*b*, and on the other hand, subdivides actuator chamber 9 into a first, fuel-filled region 5 and a second, fuel-free region 18 in fluid-tight manner. First region 5 of actuator chamber 9 is at least partially filled with fuel which, due to the higher pressure, enters first, fuel-filled region 5 from pressure chamber 4 via a sealing gap 17 formed on the surface of pressure-compensation plunger 10.

As can furthermore be gathered from FIG. 1, one end 10*a* of pressure-compensation plunger 10 facing diaphragm 13, and one end 15 of actuator-side portion 3*b* of valve needle 3 facing diaphragm 13 has a rounded design in each case. This prevents damage to diaphragm 13, which may possibly be caused by steps or edges at the terminal regions of these components when diaphragm 13 is shifted or bulges during actuation of device 1.

As shown in FIG. 1, a fuel return line 14 branches off from first, fuel-filled region 5 of actuator chamber 9. This fuel return line 14 returns the fuel to a fuel reservoir (not shown here), the fuel collecting via sealing gap 17 of pressure-compensation plunger 10 due to the pressure dissipation from pressure chamber 4 to first region 5. Since ambient pressure prevails in the fuel reservoir and thus also in first region 5 of actuator chamber 9, the fuel return from first, fuel-filled region 5 of actuator chamber 9 to the fuel reservoir takes place in non-pressurized manner. Due to the fact that ambient pressure also prevails in second, fuel-free region 18 of actuator chamber 9, essentially the same pressure is applied on both sides of diaphragm 13. In other words, pressure equilibrium exists at diaphragm 13.

In addition, a free travel spring 12 is disposed in actuator chamber 9, between armature 7 and a termination element 21, which braces actuator-side portion 3*b* of valve needle 3 with armature 7 fixed thereon at a termination element 21. An electrical connection line 22 for actuator 6 is routed through termination element 21, to the outside. Free travel spring 12 is designed in such a way that actuator-side portion 3*b* of valve needle 3 rests against diaphragm 13 even when actuator 6 is not actuated. In addition, the geometry is developed such that injection-side portion 3*a* of valve needle 3 rests against diaphragm 13 even when actuator 6 is not actuated (closed valve needle). Due to the contact of actuator-side and injection-side portions 3*a*, 3*b* of valve needle 3 on both sides in all operating states, a quasi-rigid component combination of device 1 according to the present invention for actuating valve needle 3 is achieved. A slight radial offset or a slight angular offset at diaphragm 13 possibly existing between actuator-side and injection-side portions 3*a*, 3*b* of valve needle 3 following the assembly may be tolerated since it has no influence on the faultless and operationally reliable function of device 1 according to the present invention.

Due to the afore-described placement and configuration of the individual components, a simpler and more rapid production with regard to measuring and bearing tolerances is achievable since actuator 6 having actuator-side portion 3*b* of valve needle 3 and injection-side portion 3*a* of valve needle 3 with surrounding valve body 2 are able to be produced and tested separately from each other. This entails both an overall lower testing and production effort and a lower risk of substandard parts and contributes to considerable cost savings in the production costs of these high-pressure injectors.

What is claimed is:

1. A device for injecting fuel, comprising:

a valve body;

an outwardly opening valve needle, which is disposed in the valve body in a pressure chamber filled with fuel, to which pressurized fuel is supplied;

a restoring element, which returns the valve needle to an original position;

an electromagnetic actuator, which is disposed in an actuator chamber for actuating the valve needle; and a diaphragm, which is disposed in the actuator chamber and subdivides the actuator chamber into a first, fuel-filled region and a second, fuel-free region in fluid-tight manner, and which subdivides the valve needle into an injection-side portion and an actuator-side portion;

wherein the injection-side portion of the valve needle includes a pressure-compensation plunger, which separates the pressure chamber from the first, fuel-filled region of the actuator chamber, and wherein the actuator is disposed in the second, fuel-free region, wherein the pressure-compensation plunger is distinct from the valve needle.

2. The device of claim 1, wherein the pressure-compensation plunger is disposed with slight play in a cylindrical bore of the valve body and has a sealing gap for reducing the pressure from the pressure chamber to the first region of the actuator chamber.

3. The device of claim 1, wherein a fuel return line branches off from the first region of the actuator chamber to a fuel reservoir.

4. The device of claim 1, wherein the same or essentially the same pressure prevails on both sides of the diaphragm in the first, fuel-filled region and in the second, fuel-free region.

5. The device of claim 1, wherein an armature is disposed on the actuator-side portion of the valve needle.

6. The device of claim 1, wherein the actuator includes a free travel spring, which is configured such that the actuator-side portion of the valve needle is resting against the diaphragm even when the actuator is not actuated.

7. The device of claim 1, wherein the restoring element is configured such that the injection-side portion of the valve needle is resting against the diaphragm even when the actuator is not actuated.

8. The device of claim 1, wherein the injection-side portion of the valve needle is formed in two distinct parts, with a needle and the pressure-compensation plunger.

9. The device of claim 1, wherein the pressure-compensation plunger has a rounded end facing the diaphragm, and wherein the actuator-side portion of the valve needle has a rounded end facing the diaphragm.

10. A device for injecting fuel, comprising:

a valve body;

an outwardly opening valve needle, which is disposed in the valve body in a pressure chamber filled with fuel, to which pressurized fuel is supplied;

a restoring element, which returns the valve needle to an original position;

an electromagnetic actuator, which is disposed in an actuator chamber for actuating the valve needle, wherein the electromagnetic actuator includes a coil and an armature; and a diaphragm, which is disposed in the actuator chamber and subdivides the actuator chamber into a first, fuel-filled region and a second, fuel-free region in fluid-tight manner, and which subdivides the valve needle into an injection-side portion and an actuator-side portion, wherein, upon excitation of the coil, the actuator-side portion of the valve needle is movable;

wherein the injection-side portion of the valve needle includes a pressure-compensation plunger, which separates the pressure chamber from the first, fuel-filled region of the actuator chamber, and wherein the actuator is disposed in the second, fuel-free region, wherein the pressure-compensation plunger is distinct from the valve needle.

* * * * *